United States Patent [19]

Anderson

[11] Patent Number: 4,807,838

[45] Date of Patent: Feb. 28, 1989

[54] TABLE LEG WITH WIRE RACEWAY

[75] Inventor: Bradley T. Anderson, Muskegon, Mich.

[73] Assignee: Shaw-Walker Company, Muskegon, Mich.

[21] Appl. No.: 221,002

[22] Filed: Jul. 18, 1988

Related U.S. Application Data

[63] Continuation of Ser. No. 146,041, Jan. 20, 1988.

[51] Int. Cl.[4] ..... F16M 11/20

[52] U.S. Cl. ..... 248/188.1; 248/188; 248/188.8

[58] Field of Search ..... 248/188.1, 188, 188.8, 248/188.9, 188.91, 163.1; 108/23, 150

[56] References Cited

U.S. PATENT DOCUMENTS

| | | | |
|---|---|---|---|
| 1,506,377 | 8/1924 | Mandel | 248/188.1 X |
| 2,748,262 | 5/1956 | McCrea | 108/23 X |
| 4,448,378 | 5/1984 | Binfare | 108/150 X |
| 4,562,986 | 1/1986 | Frascaroli et al. | 248/188.1 |
| 4,653,710 | 3/1987 | Dickison | 108/150 X |

FOREIGN PATENT DOCUMENTS

| | | | |
|---|---|---|---|
| 61-04493 | 8/1986 | Japan | 108/23 |

*Primary Examiner*—Ramon O. Ramirez
*Attorney, Agent, or Firm*—Kinzer, Plyer, Dorn, McEachran & Jambor

[57] ABSTRACT

A hollow table leg assembly for supporting a tabletop having a vertical passage extending therethrough. The assembly includes a top plate which is fastened to the underside of the tabletop at the vertical passage. A downwardly-extending, circular protuberance is formed in the top plate and defines a recess beneath the vertical passage in the tabletop. A downwardly-facing annular lip is formed on the protuberance below the recess. A plurality of wire passages are formed in the protuberance around a central passage. Three downwardly-projecting ribs are formed on the underside of the top plate and extend radially inwardly of the annular lip. A base member having legs and a centrally located, vertically-extending passage with an upwardly-facing, annular recessed shoulder is formed around the passage. A tab extends across the shoulder. A cylindrical tube extends between the top plate and the base member. The top end of the tube and the bottom end of the tube is seated on the recessed shoulder of the base member. Notches are formed in the top and bottom ends of the tube to receive the ribs and the tab to lock the tube against rotation. A plug closes the central passage of the base member. The plug has a collar which engages the base member around its central passage and a hub portion which extends into the tube. Wire passages and a central passage extend axially through the plug. A threaded rod extends from the recess of the top plate, through the central passage thereof, through the tube and through the central passage of the plug. Nuts engage the ends of the threaded rod, the top plate and the plug to hold the assembly together.

6 Claims, 2 Drawing Sheets

Fig. 3.
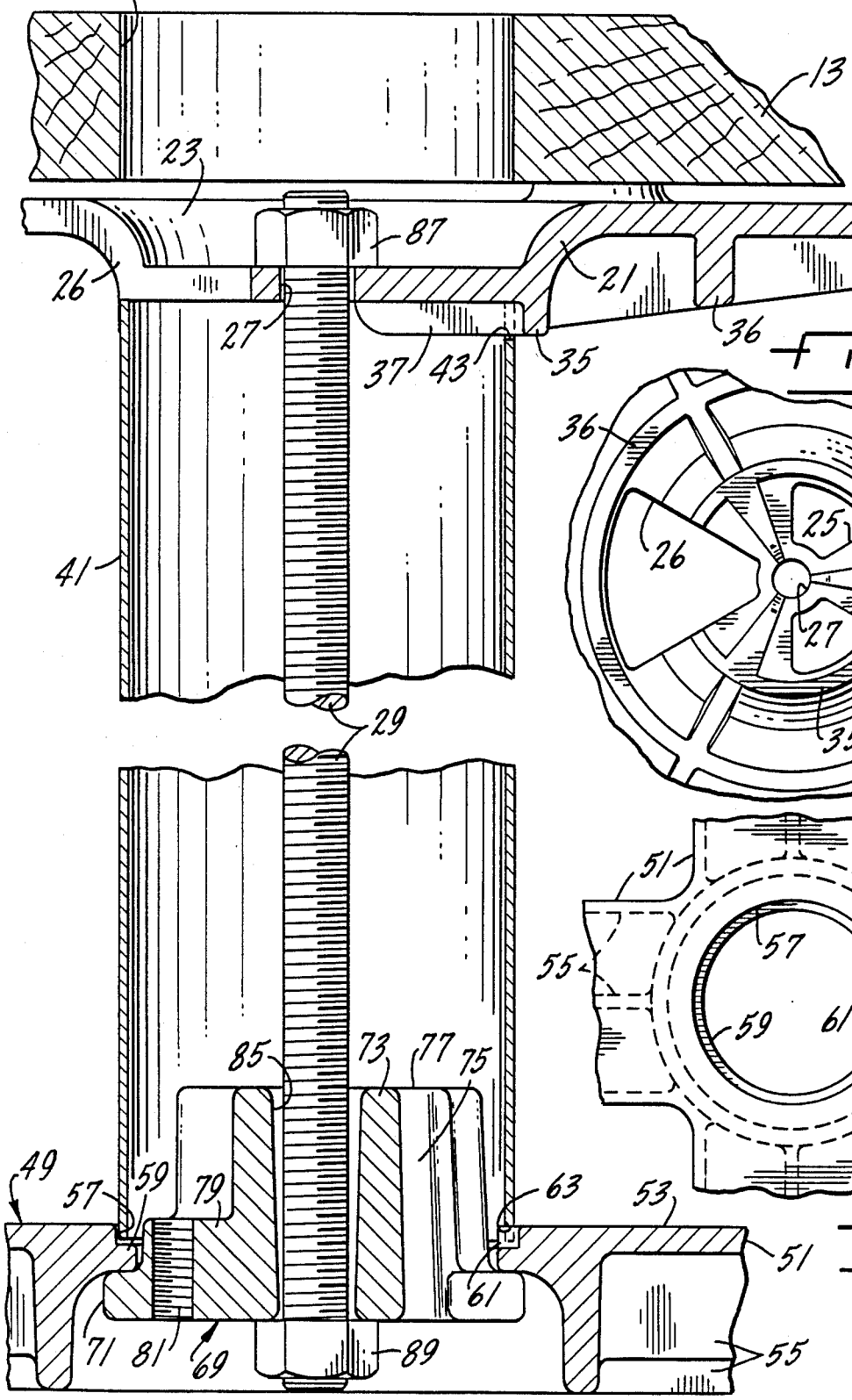
Fig. 4.
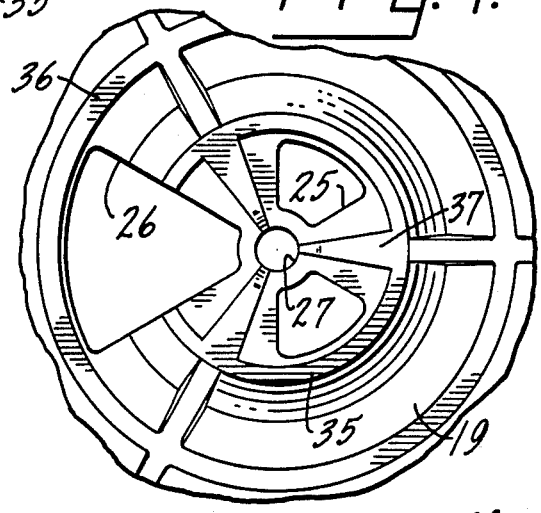
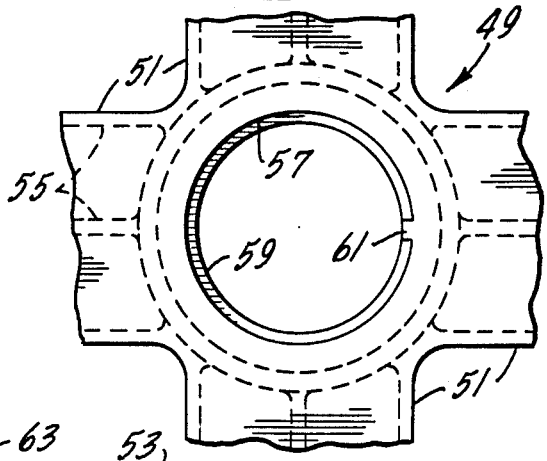
Fig. 5.

TABLE LEG WITH WIRE RACEWAY

This is a continuation of co-pending application Ser. No. 146,041 filed on Jan. 20, 1988.

BACKGROUND AND SUMMARY OF THE INVENTION

This invention is directed to a hollow table leg assembly which functions both as a support and a raceway to carry wires, both power and communication wires, to electrical fixtures and communication instruments on the tabletop through a hole in the tabletop and to the undersurface of the tabletop.

An object of this invention is to provide power and communication wires to fixtures and instruments on the tabletop while eliminating unsightly wires hanging over one side or the other of a table.

Another object of this invention is a hollow table leg assembly that can be used as the sole support of a table or as one of multiple supports of a table.

Another object of this invention is a hollow table leg assembly that can be easily assembled and disassembled.

Another object of this invention is a hollow table leg assembly for carrying power and communication wires that has wide passages so that wires can easily be inserted and removed while the leg is in place, supporting the table.

Other objects of the invention may be found in the following specification, claims and drawings.

BRIEF DESCRIPTION OF THE DRAWINGS

The invention is illustrated more or less diagrammatically in the following drawings wherein:

FIG. 3 is a partial, vertical cross-sectional view of the assembled table leg assembly of this invention;

FIG. 4 is a partial, bottom plan view of the top plate of this invention; and

FIG. 5 is a partial, top plan view of the base of this invention.

DESCRIPTION OF THE PREFERRED EMBODIMENT

Figure 1:
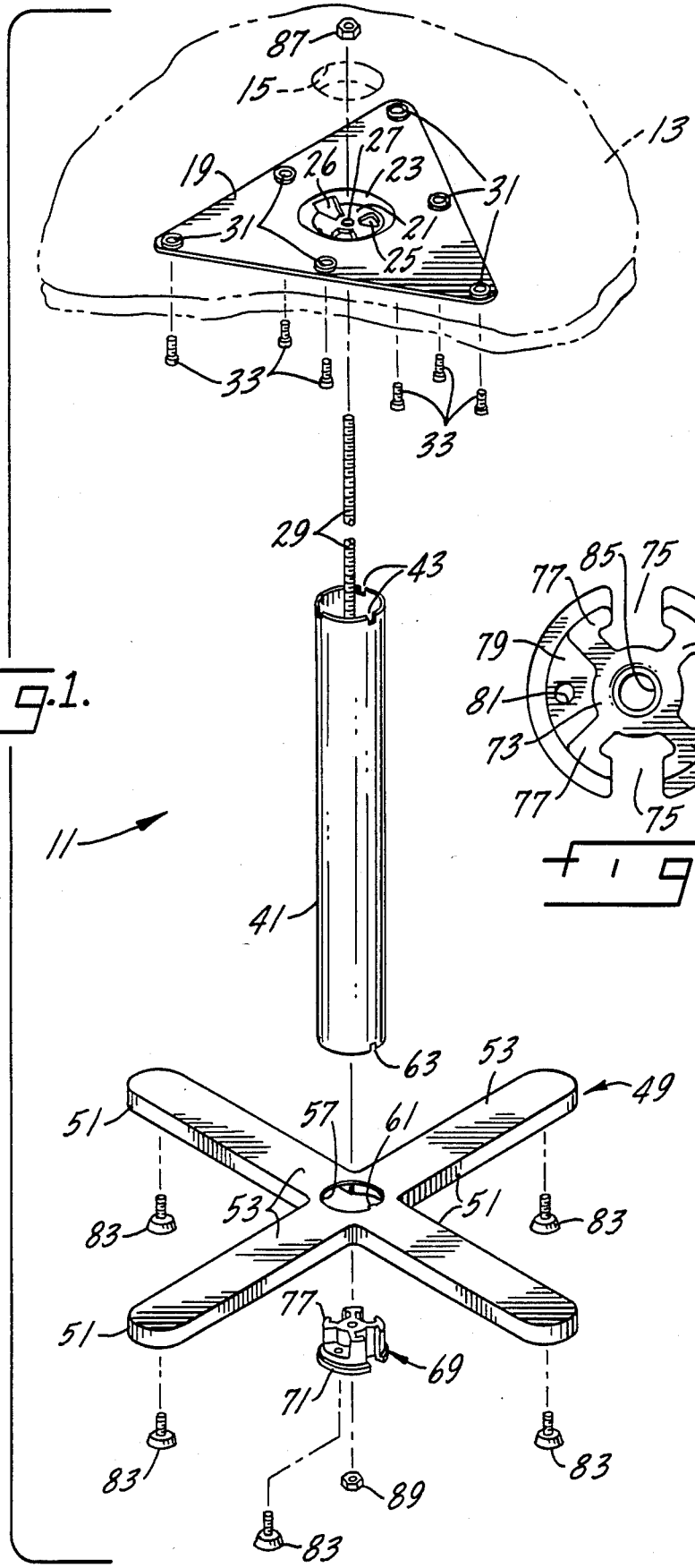
FIG. 1 is an exploded view of a hollow table leg assembly of this invention, with the tabletop shown in phantom lines.
Figure 2:
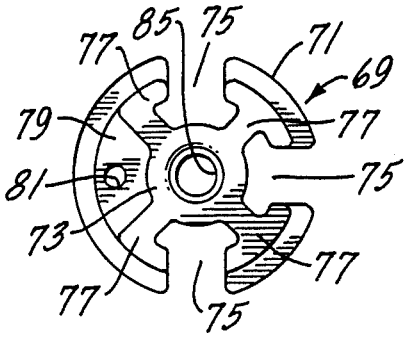
FIG. 2 is a top plan view of the base plug of this invention.

The hollow table leg assembly 11 of this invention is shown in an exploded view in FIG. 1 and in an assembled view in FIG. 3 of the drawings. The leg assembly 11 is used either alone or in combination with another leg assembly to support a tabletop 13 which is provided with a circular vertical passage 15 through the tabletop. This passage 15 can be provided anywhere in the tabletop, preferably close to the fixtures or instruments to be connected to the wiring, and where it can be aligned with a leg assembly.

The hollow table leg assembly 11 of this invention includes a top plate 19, which in this case is triangular in shape, but, of course, any other suitable shape may be used. The top plate is formed with a downwardly-extending protuberance 21, centrally located in the plate, which aligns with the circular vertical passage 15 cut in the tabletop. The protuberance forms a recess 23 between the top plate and the underside of the tabletop 13. Formed in the protuberance are three somewhat wedge-shaped passages 25 and 26, equally spaced around a central, circular passage 27. Wedge-shaped passages 25 are essentially the same size while passage 26 is considerably larger than passages 25 and extends through the arcuate side wall of the protuberance to provide access to the underside of the tabletop 13. The wedge-shaped passages are intended to receive wires, while the circular central passage will receive a threaded connecting rod 29 which holds the leg assembly together. Wedge-shaped passage 26 allows wires to be extended along the undersurface of the tabletop 13. The top plate is provided with a plurality of spaced openings 31 which receive screws 33, which fasten the top plate to the underside of the tabletop. Of course, it should be understood and appreciated that other methods of fastening the top plate to the underside of the tabletop are contemplated.

A downwardly-facing annular lip 35 is formed around the lower portion of the protuberance 21 and a similar lip 36 is formed outwardly of the protuberance 21 for strengthening. The passages 25 are located inside the annular lip 35 while the passage 26 cuts through this lip and terminates inside the annular lip 36. Three radially-extending, downwardly-projecting ribs 37 are formed on the underside of the top plate and converge at the central opening 27 between the wedge-shaped passages 25 and 26.

A cylindrical metal tube 41 is seated against the top plate 19 inside of the downwardly-facing annular lip 35. The upper end of the cylindrical tube is equipped with three notches 43, each of which receives one of the ribs 37 of the top plate to lock the cylindrical tube against rotation relative to the top plate.

At the lower end of the leg assembly 11 is a metal base member 49, which in this example has four legs 51 in the shape of a cross. It should be understood and appreciated that different styles of base members may be used having either two, three or four legs 51, depending on the use to which the support assembly is put. In the example shown herein where there are four legs, the leg assembly can function as the sole support of a table or can also function as a support at one end of a large table, such as a conference table. The base member in this example is formed of cast aluminum, and each leg has a flat top surface 53 with downwardly-projecting strengthening ribs 55 forming the sides and middle of each leg, as can be seen most clearly in FIGS. 3 and 5 of the drawings. A vertically-extending, circular passage 57 is formed in the flat top surface 53 of the base member at the intersection of the legs. An upwardly-facing, annular recessed shoulder 59 is formed around said passage to receive and support the lower end of the cylindrical tube 41. A tab 61 extends radially across the shoulder and is received in a notch 63 formed in the lower end of the cylindrical tube 41 to align and secure the cylindrical tube 41 against rotation relative to the base member 49.

A plug 69 is installed in the passage 57 of the base member 49 and includes a collar 71 which engages the base member around the central passage and a hub portion 73 which extends into the cylindrical tube 41. A plurality of wire passages 75, three in number in this embodiment of the invention, are defined by ribs 77 which extend radially outwardly from the hub 73 of the plug. The passages extend axially through the plug and radially outwardly to facilitate the installation of wires through the passages. A web 79 is provided between one pair of ribs 77, and a threaded opening 81 is formed in the web to hold a leveler 83. Other levelers 83 may be installed in the ends of the legs 51 of the base member 49.

A central passage 85 is provided through the hub 73 of the plug 69 to receive the threaded rod 29. Nuts 87 and 89 are threaded on the upper and lower ends respectively of threaded rod 29 and engage the top plate 19 and the plug 69 to hold the assembly together. When assembled, the nut 87 is located in the recess 23 of the top plate, and the nut 89 is positioned in the base member 49. With the leg assembly 11 in its assembled position, wires can easily be passed through the wedge-shaped passages 25 and 26 in the top plate 19, through the inside of the cylindrical tube 41, and through the passages 75 in the bottom plug 69, thereby providing access to the circular passage 15 in the tabletop 13, and thus to whatever electrical fixtures or communication instruments on the tabletop which are to be connected to these wires. Wires may also be passed through the wedge-shaped passage 26 to the underside of the tabletop 13.

Assembly is simplified because the nuts 87 and 89, which hold the tabletop assembly 11 together, are accessible through the opening 15 in the tabletop or through the bottom of the base member 49. Also, the weight of the tabletop is supported by the cylindrical tube 41 applied directly to the base member 49 and not by the threaded rod 29, thereby facilitating the assembly and disassembly of the leg because the threaded rod only holds the parts together.

I claim:

1. A hollow table leg assembly for installation in a table having a tabletop with a vertical passage extending therethrough, said assembly including:

a top plate having means to attach the top plate to the underside of the tabletop at the vertical passage, a downwardly-extending, circular protuberance formed in the top plate to define a recess beneath the vertical passage in the tabletop and a downwardly-facing annular lip formed on the protuberance below the recess, a plurality of passages formed in the protuberance including a central passage, at least one downwardly-projecting rib formed on the underside of said top plate and extending inwardly of said annular lip, a base member having a central, vertically-extending passage with an upwardly-facing, annular recessed shoulder formed around said passage and a tab extending radially across the shoulder, a cylindrical tube extending between the top plate and the base member, with the top end of the tube seated inside the annular lip of the top plate protuberance, and the bottom end of the tube seated on the recessed shoulder of the base member, at least one notch formed in each of the top and bottom ends of the tube to receive the downwardly-projecting rib and radially-extending tab, respectively, to lock the tube against rotation, a plug adapted to close the central passage of the base member, said plug including a collar to engage the base member around its central passage and a hub portion which extends into the tube, a plurality of passages extending axially through said plug including a central passage, a threaded rod extending from the recess of said top plate through the central passage thereof, through said tube, and through the central passage of said plug, and fastening means to engage said threaded rod, the top plate and the plug to hold the assembly together.

2. The hollow table leg assembly of claim 1 in which the plurality of passages in the protuberance and the plug include wire passages with an equal number of wire passages formed in the protuberance and in the plug.

3. The hollow table leg assembly of claim 1 in which the plurality of passages in the plug include wire passages, with said passages opening radially as well as axially.

4. The hollow table leg assembly of claim 1 in which some of the passages in the protuberance are wedge-shaped, one of the wedge-shaped passages is larger than the other wedge-shaped passages, and said larger wedge-shaped passage extends through the protuberance to the underside of the tabletop.

5. A hollow table leg assembly for installation in a table having a tabletop with a vertical passage extending therethrough, said assembly including:

a top plate having means to attach the top plate to the underside of the tabletop at the vertical passage, a downwardly extending circular protuberance formed in the top plate to define a recess beneath the vertical passage in the tabletop, a plurality of passages formed in the protuberance including a central passage, a base member having a central, vertically extending passage, a cylindrical tube extending between the top plate and the base member, means to seat the cylindrical tube in the top plate and the base member, means formed in the top plate, the bottom member and the cylindrical tube to lock the tube against rotation relative to the top plate and bottom member, a plug adapted to close the central passage of the base member, a plurality of passages extending axially through said plug including a central passage, a threaded rod extending from the recess of said top plate through the central passage thereof, through said tube, and through the central passage of said plug, and fastening means to engage said threaded rod, the top plate and the plug to hold the assembly together.

6. A top plate forming a part of a hollow table leg assembly for installation on a table having a tabletop, said top plate including:

a flat portion adapted to engage the underside of the tabletop, openings formed in said flat portion to receive fasteners to attach said top plate to the underside of said tabletop, a downwardly extending curved wall forming a protuberance having a flat bottom wall, with the protuberance forming a recess beneath the tabletop, a plurality of downwardly opening passages formed in the flat bottom wall of the protuberance and leading into said recess including a central passage, means formed around said flat bottom wall of said protuberance to receive and seat a central tube communicating with the downwardly opening passages, at least one of said downwardly opening passages also extending through said curved wall of the protuberance to provide communication from said cylindrical tube to the underside of the tabletop.

* * * * *